United States Patent [19]

Ferguson

[11] 4,071,239

[45] Jan. 31, 1978

[54] DEMOUNTABLE PRACTICE DEVICE ATTACHABLE TO THE STRINGS OF A STRINGED RACQUET

[76] Inventor: Thomas W. Ferguson, 801 S. 75th, Tacoma, Wash. 98408

[21] Appl. No.: 678,218

[22] Filed: Apr. 19, 1976

[51] Int. Cl.[2] ..... A63B 61/00

[52] U.S. Cl. ..... 273/29 A; 273/58 C; 273/97 R

[58] Field of Search ..... 273/26 E, 29 A, 95 A, 273/98, 97 R, 58 C, 73 R, 73 D; 46/177; 24/3 M, 129 B, 129 R, 143 B

[56] References Cited

U.S. PATENT DOCUMENTS

| | | | |
|---|---|---|---|
| 319,030 | 6/1885 | Ross | 24/129 B |
| 922,432 | 5/1909 | Jirotka | 273/97 R |
| 1,225,623 | 5/1917 | Hall et al. | 24/143 B |
| 3,351,343 | 11/1967 | Papp | 273/58 C |

FOREIGN PATENT DOCUMENTS

| | | | |
|---|---|---|---|
| 361,802 | 8/1938 | Italy | 273/97 R |
| 17,441 of | 1894 | United Kingdom | 273/97 R |

*Primary Examiner*—Richard C. Pinkham
*Assistant Examiner*—T. Brown
*Attorney, Agent, or Firm*—Graybeal, Barnard & Uhlir

[57] ABSTRACT

A demountable practice device for use with a conventional stringed racquet such as a tennis racquet or the like and including an elastic tether attached to a flexural, arcuate anchor member mounted solely on the racquet strings so that striking of the ball generates potential energies in both the racquet strings and anchor member as well as the potential energy in the stretched tether. Opposed ears located on opposite spaced side edges of the anchor member are received through respective string openings to position the anchor member against the racquet face opposite the striking face. An elastic tether extends through a central string opening to the opposite face and is adjustably attached to the anchor member. A cross member at the outward end of the tether secures a conventional ball which is repeatedly struck by the racquet face opposite the anchor member.

23 Claims, 6 Drawing Figures

Fig. 1.
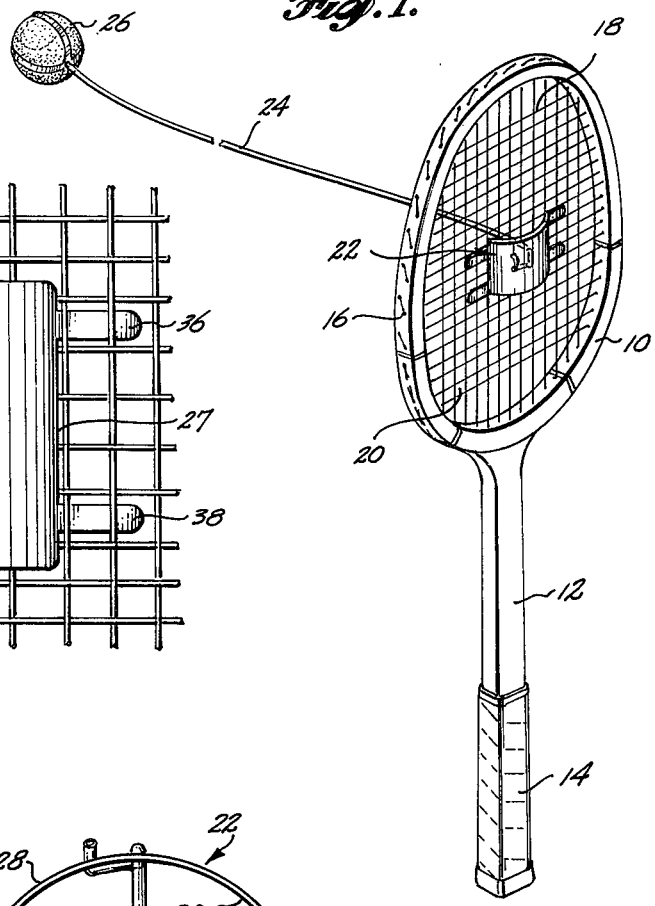
Fig. 2.
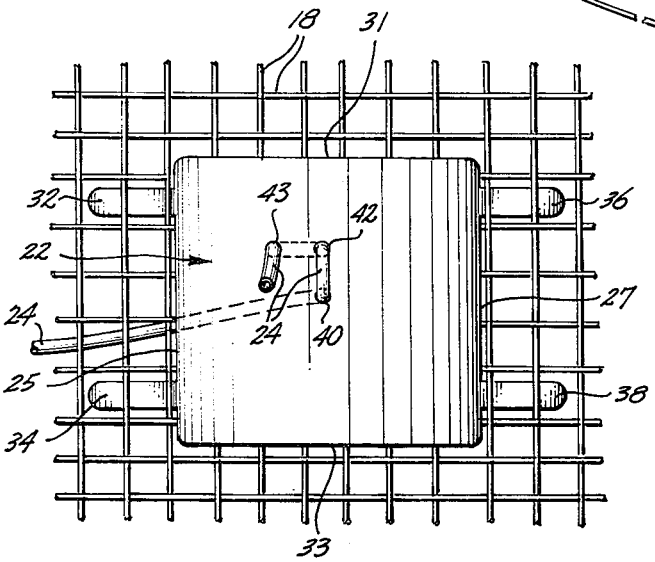
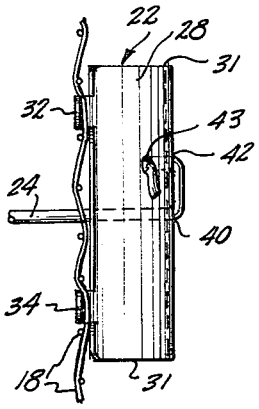
Fig. 3.
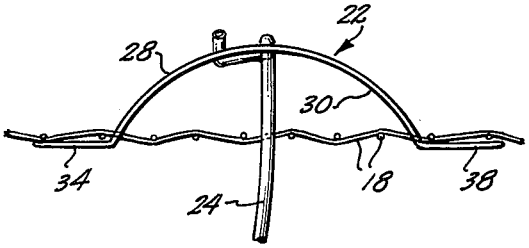
Fig. 4.
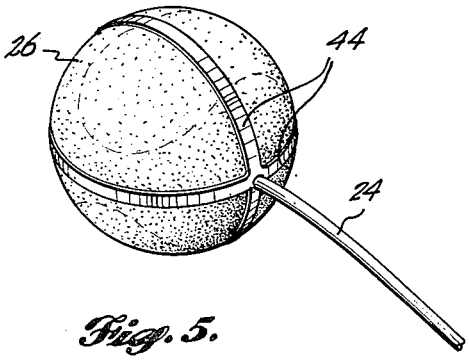
Fig. 5.
Fig. 6.
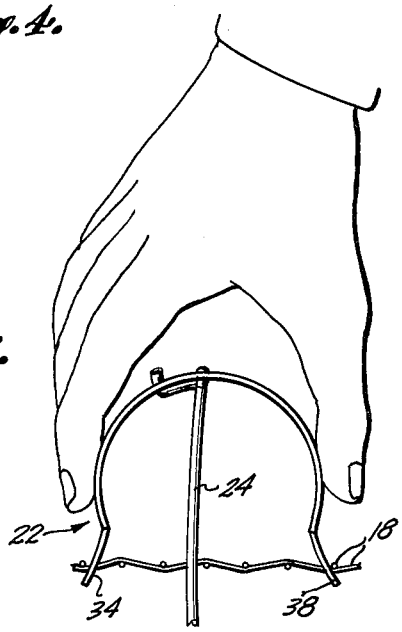

DEMOUNTABLE PRACTICE DEVICE ATTACHABLE TO THE STRINGS OF A STRINGED RACQUET

BACKGROUND OF THE INVENTION

1. Field of the Invention

This invention relates to a device for practicing racquet swings, and more particularly, to a detachable string mounted practice device having a flexural anchor member securing an elastic tether in turn attached to a game ball strikable by the racquet strings. The anchor member is retained on the racquet face solely by engagement with the tensioned strings so that striking of the ball generates potential energies in both the racquet strings and the anchor member.

2. Description of the Prior Art

Numerous prior art devices have been proposed which would assist a tennis player in practicing tennis swings. One type of such device comprises a practice ball, tethered to a support assembly separate from the racquet or bat. Examples of such apparatus are shown in U.S. Pat. No. 2,270,957, granted Jan. 27, 1942, to S. W. Mirrs, and U.S. Pat. No. 1,862,044, granted June 7, 1932, to T. M. Flight.

Also of interest is the type of tennis practice device which has a tethered ball attached to the handle portion of a tennis racquet such as that shown in U.S. Pat. No. 3,709,490, granted Jan. 9, 1973, to Gunther Pruss. The disadvantage of attaching the tether to the handle portion of the tennis racquet is that the ball may tend to return toward the handle portion of the racquet. Additionally, the misdirection of the ball will be accentuated when using an extremely short tether.

Of particular interest is the type of tennis practice device depicted in U.S. Pat. No. 3,110,084, granted Mar. 1, 1938, to R. Heimers. This system has an elastic tether which is wrapped around an upper and lower roller assembly and has a projectable ball attached at its outward end. A central roller assembly is positioned adjacent to one face of the string portion of the tennis racquet and guides the tether from the central portion of the racquet head. A clamp on the frame assembly is attachable to the handle of a conventional tennis racquet or the like. This device is bulky and weighty and significantly changes the balance of the tennis racquet to which it is attached.

Of general interest, also, are numerous games which involve the striking of a restrained projectable object by a bat or the like, such as those disclosed in Canada Pat. No. 456,645, granted May 17, 1975, to Samuel Clay; U.S. Pat. No. 1,282,016, granted Oct. 15, 1918, to H. O. McHenry; and U.S. Pat. No. 3,503,611, granted Mar. 31, 1970, to Francis A. McPherson.

SUMMARY OF THE INVENTION

The present invention relates to a device for practicing tennis swings, and, more particularly, to a demountable assembly for a conventional tennis racquet which includes a tethered ball projectable by striking.

According to one aspect of the invention, a flexural, arcuate anchor member is demountably positioned on the strings at one face of a conventional stringed racquet, for striking by the opposite racquet face. An elastic tether is adjustably secured to the anchor member as by a plurality of openings through which the tether is successively led. The striking of the ball by the racquet face generates potential energies in both the racquet strings and anchor member to enhance the ball rebound action.

According to another aspect of the invention, a detachable flexural anchor member is juxtaposed the string portion of a tennis racquet and adjustably secures an elastic tether. Opposed elongated projections or ears are attached to each spaced side edge of the anchor member and are sized to be received through the openings defined by and retained by the racquet strings.

According to another aspect of the invention, an elastic tether for a demountable tennis practice device is provided with first and second ends, the first end being attached to an anchor member juxtaposed the string portion of a tennis racquet, and the second end being provided with an elastic cross member or like attached means which is detachably engageable with a conventional tennis ball without damage to the ball.

According to another aspect of the invention, a flexural anchor member of a detachable tennis practice device is positioned adjacent the string portion of a racquet face by initially squeezing the elongated edges toward each other. Projections, positioned on each edge of the anchor member, are inserted through the openings defined by the parallel strings. The edges are then released allowing the anchor member to return toward its initial relaxed configuration affixing the anchor member to the planar string face.

According to still another aspect of the invention, an anchor member of a tennis practice device is provided with a plurality of openings sized to receive an elastic tether therethrough. The elastic tether is interwoven through the plurality of openings locking the elastic tether to the anchor member.

In view of the foregoing, it is an object of this invention to provide a demountable practice device which is quickly and easily attachable to a conventional tennis racquet or the like but is readily removable to permit conventional usage of the racquet.

It is another object of the invention to provide a tennis practice device with increased rebound velocity of the tethered ball to more nearly simulate the action of a ball hit toward the racquet by another player.

It is another object of the invention to provide a detachable tennis practice device in which the length of the tether attached to a tennis ball can be easily adjusted.

It is yet another object of the invention to provide a detachable tennis practice device which is simple to construct yet durable in use.

It is still another object of the present invention to provide a tennis practice device which can be attached to the string portion of a tennis racquet in a few seconds time.

It is another object of the invention to provide a tennis practice device which is light, flexible and compact so it can be transported with the tennis racquet, as in a conventional racquet head cover or the like.

It is still another object of the invention to provide a tennis practice device which can be detachably mounted on the same racquet utilized by a tennis player for actual game play.

It is yet another object of the invention to provide a detachable tennis practice device which is very light so that the balance and weight of a conventional tennis racquet will not be significantly changed during its use.

These and other features, objects and advantages will be apparent from the following description taken in conjuncton with the drawings.

BRIEF DESCRIPTION OF THE DRAWINGS

FIG. 1 is a pictorial view showing a demountable tennis practice device for practicing tennis swings according to the instant invention attached to a typical tennis racquet;

FIG. 2 is an enlarged scale, fragmented, front elevational view, depicting an anchor member according to the instant invention positioned on the string portion of a tennis racquet;

FIG. 3 is a side elevational view of the anchor member shown in FIG. 2;

FIG. 4 is an end elevational view of the anchor member shown in FIG. 2;

FIG. 5 is an enlarged scale view illustrating the elastic cross member of the elastic tether cord attached to a tennis ball; and FIG. 6 is an end elevational view showing the anchor member positioned for placement of the stringed portion of a racquet.

DETAILED DESCRIPTION OF THE PREFERRED EMBODIMENT

Referring initially to FIG. 1, a conventional tennis racquet is shown having a demountable tennis practice device for practicing tennis swings attached to the head portion of the racquet. As is known, a tennis racquet is essentially planar and has a frame including a head 10, often oblong, with a handle 12 and handgrip 14 extending outwardly away from the head. A plurality of aligned openings 16 are formed through the racquet head 10 along mutually perpendicular axes. Strings 18 are received through openings 16 and are interwoven across the opening in racquet head 10 under tension forming a pair of opposite faces. Accordingly, a plurality of square openings 20 are formed by the perpendicular crossings of the tensioned strings in the central portion of racquet head 10.

According to the preferred embodiment of the invention, a flexural anchor member 22 is demountably positionable on one face of the stringed portion of the racquet head 10. An elastic tether 24 of rubber or the like is adjustably secured to anchor member 22 and is adapted to be attached at its outer end to a conventional game ball 26.

As best seen in FIGS. 2 through 4, anchor member 22, as viewed along an axis perpendicular to the plane of the racquet face, is rectangularly shaped, having a spaced pair of substantially parallel side edges 25, 27. As best seen in FIG. 4 anchor member 22 is slightly arcuate or bowed, as viewed from an end, suitably conforming generally to the shape of a segmented cylinder.

Accordingly, if the anchor member 22 is placed on a generally planar surface its central portion between the spaced side edges is slightly elevated. Hence, a convex surface 28 and concave surface 30 are formed on opposite ends thereof. Of course, other configurations of anchor member 22 can be employed insofar as such a configuration is arcuate to displace a portion of the surface of the anchor member from the plane of the racquet face.

In the preferred form, anchor member 22 is fabricated from a 3/16 inch sheet of flexural material such as polyethylene. This material has a flexural or resilient characteristic such that if the anchor member 22 is deformed toward a more cylindrical form from its initial arcuate configuration, such as by squeezing its side edges 25, 27 toward each other, it tends to return toward its more planar initial configuration when released.

Anchor member 22 is suitably cut from a planar sheet to the shape depicted in FIG. 2. Its external dimensions are typically approximately three and one-half inches to two and one-half inches, with the opposed ears 32, 34, 36, 38 thereof extending outwardly from the side edges approximately one inch. After being cut or otherwise formed to size, the anchor member is heat molded on a cylinder or the like form to a bowed or articulate configuration (FIG. 4) which approximately corresponds to a segmented cylinder. It is to be understood however, that numerous different types of materials, sheeting thickness and dimensional sizing could be employed in conjunction with the herein disclosed invention in addition to employing different processes for forming the same.

Referring specifically to FIG. 2, mounting ears 32, 34 are attached to anchor member 22 near opposite ends of edge 25 and extend laterally outwardly for engaging the racquet strings. Similarly, ears 36, 38 are attached to anchor member 22 near either end of edge 27 and extend outwardly in a direction opposite ears 32, 34. Each ear has a width suitably slightly smaller than the rectangular opening 20 formed by the perpendicular crossing of strings 18. Preferably, each ear has a sufficient length, approximately one inch, so that the surface in contact with the racquet strings of each opposite face touches at least three strings. However, it should be understood that the ears can be of any length which firmly secure the anchor member 22 to the racquet face. As best seen in FIG. 4, the outward portion of each ear is preferably essentially flat, while its portion closest to its point of attachment with the edge of anchor member 22 is curved. In preferred form, the thickness of each ear tapers toward its outward end so that it presents a minimal amount of interference with the tennis ball as it is struck by the opposite racquet face along which the ears extend. It should also be understood that, although in preferred form two ears are attached to the opposite edges of anchor member 22, only a single ear on each edge 25, 27 is required to secure anchor member 22 to the stringed portion of racquet head 10.

As has been previously described, elastic tether 24 is connected to anchor member 22 which, in turn, is releasably attachable to a tennis ball 26 or the like. Referring now to FIGS. 2 and 3, a first opening 40 is formed near the center of anchor member 22. A second opening 42 is disposed laterally from first opening 40 generally along the axis midway between side edges 25, 27 and toward end edge 31. A third opening 43 is laterally displaced from both first and second openings 40, 42 and is positioned generally between second opening 42 and edge 25.

In securing elastic tether 24 to anchor member 22, the free end of the tether is first inserted through first opening 40 along concave surface 30. Next, the free end is inserted through second opening 42 along convex surface 28 and the slack removed from the concave surface. Finally, the free end is inserted through opening 42 from concave surface 30 so that its free end extends along convex surface 28. The diameter of openings 40, 42, 43 are preferably sized very slightly larger than the diameter of elastic tether 24 such that the tether is somewhat loosely received therein. However, the spaced apart configuration of the openings with the tether tightly interwoven therethrough, effectively locks the side wall of the tether to anchor member 22. Accordingly, tensioning elastic tether 24, such as by striking and propelling the ball away from the racquet face, is resisted by and combined stretching of elastic tether 24 in conjunction with the springiness of anchor member 22 and the tensioned racquet strings. In addition, it has been found that by using three such openings generally positioned as described, elastic tether 24 remains fixedly attached to anchor member 22 while in use. Of course, as would be expected, the more openings through which elastic tether 24 is woven, the greater the drag friction on the tether. Additionally, other methods such as a knot, clip, or the like can be used to secure the elastic tether 24 to anchor member 22.

As was indicated hereabove, a projectile or ball, preferably a conventional game ball, is releasably attached to the outward end of elastic tether 24. Referring now to FIG. 5, an elastic cross fastener 44 is attached to the outward end of elastic tether 24 and is releasably affixable to the surface of ball 26 generally along two mutually perpendicular circumferences. Ball 26 can be quickly and easily attached to tether 24 by stretching the cross fastener 44 around the spherical surface of ball 26. Preferably, elastic tether 24 and cross fastener 44 are formed as a single molded unit and can either be solid or tubular in cross-sectional configuration.

It has been previously described that anchor member 22 is detachably affixed to the strings stretched across the opening in racquet head 10, thereby allowing conventional game use of the tennis racquet. In addition, the practice device of the instant invention is light and does not significantly change the weight or balance of the racquet. The same racquet used by a tennis player to practice tennis swings can thus also be used in game play. As will be appreciated, this is extremely important since the weight and balance of different tennis racquets can vary slightly.

Referring now to FIGS. 1–4, the method of mounting a demountable practice device according to the instant invention on a conventional tennis racquet is next described. The free end of elastic tether 24 is first inserted through a rectangular opening 20 defined by the mutually perpendicular strings stretched across racquet head 10. Ideally, a player selects the rectangular opening in the center of that portion of the string surface where he normally strikes the ball. Most often, this opening would be the rectangular opening in the exact center of the racquet head. As mentioned herebefore, anchor member 22 is arcuate or bowed, with a convex surface 28 on one side and a concave surface 30 on the opposite side. The free end of tether 24 extending through the rectangular opening in the center of racquet head 10 is then inserted through first opening 40 (FIG. 2) in the anchor member 22 from concave surface 30. Next, the free end of elastic tether 24 is inserted through the second opening 42 from convex surface 28 and the end of the tether pulled taut from concave side 30 so that any slack on convex face 28 is removed. Thereafter, the free end of elastic tether 24 is inserted through opening 43 from concave surface 30 and the end pulled taut from convex surface 28 so that the tether substantially contacts the respective sides of the anchor member between the openings.

Anchor member 22 can now be attached to the planar face formed by the racquet strings tensioned across racquet head 10. To effect such attachment, anchor member 22 is gripped near side edges 25, 27 and squeezed so that the edges are deflected toward each other. The deflected, more cylindrical form of anchor member 22 results in the ears assuming an angular configuration with respect to the plane of the racquet strings (note FIG. 6). First opening 40, having the tether therethrough, is then aligned over the rectangular opening in the strings receiving elastic tether 24. Mounting ears 32, 34, 36 and 38 are then inserted through the rectangular string openings which are correspondingly aligned with the end of each ear. Anchor member 22 is then released and its flexural, resilient nature causes it to return toward its initial, more planar, configuration thereby causing the ears to engage the racquet strings on the face opposite anchor member 22.

Referring again to FIG. 1, it is to be understood that, although numerous different types of projectiles or balls can be attached to tether 24, most often a conventional game ball is used in conjunction with practice devices of the instant invention. When ball 26 is propelled by striking with the stringed racquet face, its outward movement is limited by the elastic tether 24. As the struck ball accelerates away from the racquet face, the energy from the strike impact is converted into potential energy and stored as stretch energy in elastic tether 24, and also as resilient energy in the flexed portion of anchor member 22, and further as resilient energy in the deflected racquet strings 18. Accordingly, when ball 26 is at its most outward point from racquet head 10, the energy of the strike impact has been fully converted to potential energy in the springiness of elastic tether 24, anchor member 22 and tensioned racquet strings 18. The rebounding ball action is thus enhanced and more nearly simulates the action of a ball hit toward the racquet by another player. Of course, shortening the length of tether 24 causes ball 26 to return toward the racquet face in a shorter period of time and hence, will require a more rapid succession of striking actions with the racquet. Conversely, by lengthening elastic tether 24, the time required for ball 26 to return toward the racquet face is increased thereby allowing a longer follow through on each stroke.

It is also to be understood that, although the demountable practice device of the instant invention is described as being attachable to the stringed portion of a conventional tennis racquet, any of the well-known types of stringed racquets employed for striking a ball could be used with the instant practice device. For example, the stringed racquets employed in racquet ball and squash are but two of the several other types of racquets to which the herein described device can be affixed.

From the foregoing, various modifications, revisions and adaptations of the game ball practice device herein disclosed will occur to those skilled in the art to which the invention is addressed, within the scope of the following appended claims.

What is claimed is:

1. A demountable practice device attachable to a conventional stringed racquet for practicing swings by striking a tethered ball, comprising:

a flexural anchor means having edge means configured to contact portions of the racquet strings on both string faces of the stringed racquet and be retained thereon solely by such contact;

an elastic tether having first and second ends, and sized to be received through an opening defined by the racquet strings, said first end being attachable to said anchor means and said second end being attachable to a ball which is strikable by the racquet face opposite the anchor means so that when said anchor means is positioned on said racquet strings, said first end is inserted through an opening defined by said racquet strings and attached to said anchor means, said second end is attached to said ball and said ball is struck by said racquet the tensioning caused by the struck ball at the outermost extent of ball travel generates potential energies in both the racquet strings and said anchor means to cause said ball to be returned towards said racquet face.

2. A demountable practice device according to claim 1, wherein said anchor means is positioned principally on one face of the stringed racquet and its edge means includes at least one pair of oppositely extending projecting ears for positioning and retaining said anchor means on said racquet face by extending through respective stringed openings and contacting portions of the racquet strings on the other racquet string face.

3. A demountable practice device according to claim 1, wherein said anchor means comprises a pair of elongated side edges of sufficient length to engage a plurality of racquet strings, and each such side edge includes at least one projecting ear extending outwardly therefrom for positioning and retaining said anchor means on said racquet strings, said elongated edges contacting the stringed racquet face when said anchor means is installed on the racquet strings.

4. A demountable practice device according to claim 1, wherein said anchor means is generally in the form of a segmented cylinder with spaced parallel side edges and said elastic tether is attached to said anchor means substantially midway between said parallel side edges.

5. A demountable practice device according to claim 4, wherein said anchor means comprises a segmented cylinder having a concave surface and a convex surface on opposite sides thereof and wherein said anchor means further includes a plurality of openings sized to receive said elastic tether, and wherein a first opening is formed through said segmented cylinder substantially at its center, said elastic tether being initially received through said first opening from said concave surface and led successively through the remaining openings and retained therein.

6. A demountable practice device according to claim 5, wherein there are second and third openings formed in the segmented cylinder, and wherein said second and third openings are displaced from each other and from said first opening.

7. A demountable practice device according to claim 1, wherein said anchor means includes spaced apart elongated side edges of sufficient length to engage a plurality of parallel racquet strings, and wherein said first end of said elastic tether is attached to said anchor means approximately midway between said elongated side edges so that tensioning caused by striking the tethered ball is distributed over the racquet strings by said elongated side edges.

8. A demountable practice device according to claim 1, wherein said anchor means comprises a segmented cylinder having a pair of substantially straight spaced side edges and a pair of curved end edges, and wherein said anchor means further includes a first opening formed in said segmented cylinder approximately midway between said spaced side edges for receiving the first end of said elastic tether, so that tensioning of said tether causes a deformation of said segmented cylinder generating potential energies therein.

9. A demountable practice device according to claim 8, wherein there are second and third openings formed in the segmented cylinder, and wherein said second and third openings are displaced from each other and said first opening, and wherein said elastic tether is initially received in said first opening and is led successively through said second and third openings and retained therein.

10. A device for practicing racquet swings by striking a tethered ball, comprising:

a racquet having a head including a pair of opposite faces formed by spaced apart tensioned strings defining openings;

a flexural anchor means comprising a segmented cylinder having a pair of substantially straight, spaced side edges and a pair of curved edges, and wherein said anchor means is positioned and retained on one face of the racquet head solely by edge means projecting from said straight, spaced apart side edges and engaging the tensioned strings;

said elastic tether, sized to be received through an openings defined by said tensioned strings, and having first and seconds ends, said elastic tether being positioned in a string opening with said first end being attached to said anchor means and said second end being attached to a ball so that the striking of said ball with the opposite face of the racquet head face generates potential energies in both the racquet strings and anchor means.

11. A demountable practice device according to claim 10, wherein said edges includes at least one pair of oppositely extending projections extending from opposite sides of said anchor means, said projections being sized to be received through respective stringed openings, said ears extending from one racquet face through said openings and contacting the racquet strings along said opposite racquet face.

12. A demountable practice device according to claim 10, wherein said side edges are of sufficient length to engage a plurality of parallel racquet strings forming said one racquet face, and wherein each such side edge includes at least one mounting projection means extending outwardly therefrom, said elongated side edges contacting said racquet face distributing potential energies over the racquet strings.

13. A demountable practice device according to claim 10, wherein said elastic tether is attached to said anchor means substantially midway between said parallel side edges.

14. A demountable practice device according to claim 13, wherein said anchor means comprises a segmented cylinder having a concave surface and a convex surface on opposite sides thereof, and wherein said anchor means further includes a plurality of openings sized to receive said elastic tether including a first opening formed through said opposite surfaces substantially at their center, said elastic tether being initially received through said first opening from said concave surface and led successively through another opening and retained thereon.

15. A demountable practice device according to claim 14, wherein there are second and third openings formed through the segmented cylinder, said second and third openings being displaced from each other and from said first opening.

16. A demountable practice device according to claim 10, wherein said straight, spaced apart, elongated side edges are of sufficient length to engage a plurality of parallel racquet strings of side one racquet face, and wherein said first end of said elastic tether is attached to said anchor means approximately midway between said elongated side edges so that tensioning caused by striking the tethered ball is distributed over the racquet strings by said elongated side edges.

17. A demountable practice device according to claim 10, wherein said anchor means further includes a first opening formed in said segmented cylinder approximately midway between said spaced side edges for receiving the first end of said elastic tether so that tensioning of said tether causes a deformation of said segmented cylinder toward said racquet strings.

18. A demountable practice device according to claim 17, wherein there are second and third openings formed in the segmented cylinder said second and third openings being displaced from each other and said first opening, and wherein said elastic tether is initially received in said first opening and is led successfully through said second and third openings and retained therein.

19. A demountable practice device according to claim 10, wherein said second end of said tether further includes a resilient cross fastener adapted to confine the tethered ball by engaging its spherical surface along substantially perpendicular circumferences.

20. A demountable practice device according to claim 19, wherein said tethered ball is a game ball, and wherein said cross fastener is attached to said game ball by stretching the cross fastener around the spherical surface of the ball.

21. In the combination of a conventional stringed racquet and a demountable practice device including an electric tether, a tethered ball, and means for anchoring the elastic tether to the strings of said racquet, the improvement wherein said tether passes through an opening provided between the strings of said racquet, said means for anchoring the elastic tether comprises a flexural body having a pair of spaced side edges, each side edge engaging certain of said strings and movably retained thereon so that tensioning in said elastic tether caused by the struck ball at the outermost extent of ball travel causes flexure of both said body and said strings whereby potential energy is stored therein.

22. The improvement of claim 21, wherein the elastic tether further includes a resilient cross member adapted to confine the tethered ball by engaging its spherical surface along substantially perpendicular circumferences.

23. The improvement of claim 21, wherein the means for anchoring the elastic tether further includes a plurality of openings sized to receive said elastic tether, and wherein one of said plurality of openings is generally centrally disposed on said means for anchoring the elastic tether, and wherein said elastic tether is initially received in said centrally disposed opening and is led successively through the remaining openings and retained therein.

* * * * *